United States Patent [19]

Knight

[11] Patent Number: 4,715,598

[45] Date of Patent: Dec. 29, 1987

[54] BASKETBALL GAME AND COURT

[75] Inventor: John K. Knight, Doncaster, Australia

[73] Assignee: R.F.D. Consultants Pty. Ltd., Melbourne, Australia

[21] Appl. No.: 776,117

[22] PCT Filed: Dec. 21, 1984

[86] PCT No.: PCT/AU84/00267

§ 371 Date: Sep. 3, 1985

§ 102(e) Date: Sep. 3, 1985

[87] PCT Pub. No.: WO85/03009

PCT Pub. Date: Jul. 18, 1985

[30] Foreign Application Priority Data

Jan. 13, 1984 [AU] Australia ..... PG3181

[51] Int. Cl.[4] ..... A63B 71/02; A63B 63/08; A63C 19/00; E04H 3/14

[52] U.S. Cl. ..... 272/3; 135/105; 273/1.5 R; 273/411; 273/402; 52/63

[58] Field of Search ..... 272/3, 1 B; 135/105; 273/1.5 R, 1.5 A, 29 R, 411, 402; 52/63, 222

[56] References Cited

U.S. PATENT DOCUMENTS

| | | | |
|---|---|---|---|
| 959,973 | 5/1910 | Tomkins | 272/3 |
| 1,556,046 | 10/1925 | Taylor | 273/411 |
| 1,846,305 | 2/1932 | Brooks | 135/105 |
| 2,379,572 | 7/1945 | Gibson | 273/1.5 R |
| 2,440,557 | 4/1948 | Power | 135/105 X |
| 2,823,034 | 2/1958 | Bingham | 273/29 R X |
| 3,137,503 | 6/1964 | Ballard | 273/1.5 R |
| 3,201,126 | 8/1965 | Nissen | 273/1.5 R X |
| 3,371,671 | 3/1968 | Kirkham | 135/105 X |
| 3,388,909 | 6/1968 | Woods | 272/3 X |
| 3,499,457 | 3/1970 | Waring et al. | 135/105 |
| 3,582,078 | 6/1971 | Katras | 273/1.5 R |
| 3,588,103 | 6/1971 | Fuller | 273/1.5 R |
| 3,602,505 | 8/1971 | Friend | 272/3 UX |
| 3,745,729 | 7/1973 | Vaughn et al. | 272/3 X |
| 3,872,634 | 3/1975 | Seaman | 52/222 |
| 4,070,805 | 1/1978 | Kastner | 273/411 |
| 4,078,795 | 3/1978 | Porter | 272/3 |
| 4,482,157 | 11/1984 | McNeil | 273/411 |

FOREIGN PATENT DOCUMENTS

| | | | |
|---|---|---|---|
| 991947 | 6/1976 | Canada | 135/105 |
| 618199 | 2/1961 | Italy | 273/1.5 R |

*Primary Examiner*—Richard J. Johnson
*Attorney, Agent, or Firm*—Stetina & Brunda

[57] ABSTRACT

A games playing area or court which has a floor surface for playing the game on, surrounded substantially continuously by a flexible wall portion and optionally a flexible roof portion, from all of which the game playing piece may be rebounded in play so as to continue the game. A goal scoring device or area is located within the confines of the games playing area and is common to all of the participants in the game thereby overcoming the requirement to have separate goal areas for each person or team. The goal scoring device is preferably centrally located in the court which is supported externally so as not to present an obstruction to the game. The game playing area is portable and may be assembled/disassembled.

18 Claims, 7 Drawing Figures

BASKETBALL GAME AND COURT

BACKGROUND OF INVENTION

The present invention relates to a game. In particular the present invention relates to a ball game that may be played indoors, and to a court for playing the game on. More particularly, the present invention relates to a modification of the game of basketball that may be played on a smaller court, particularly a court located indoors.

Although the present invention will be described with particular reference to an adaptation or modification of the game of basketball, it is to be noted that the scope of the present invention is not so limited and may extend to include all manner of other games, particularly ball games that can be played in a similar way using a similar court and equipment.

The game of basketball is usually played on a court which has goals at both ends of the court; each team throwing to and for goals at one end only which is alternately changed over to the other end at the beginning of each period of play. As both respective goal areas are spaced apart from each other, play occurs between them to more or less degree, but the majority of time play is located in the immediate vicinity of one or other of the goal areas. The area toward the center of the court is used only for traversing between ends and occasionally in play.

SUMMARY OF THE PRESENT INVENTION

Therefore, it is an aim of the present invention to provide a game, particularly an adaption or modification of basketball, in which the play area is utilized in a more efficient manner so that all of the play area of the court is used to a more or less equal amount. This aim is achieved in part by having a centrally located goal scoring area which is thrown to or at by both of the competing teams.

According to one aspect of the present invention, there is provided a games playing area for playing a game with a game playing piece, said games playing area comprising substantially planar floor playing surface, a wall portion being at least in a major part a flexible barrier means for rebounding the game playing piece into play, and a goal scoring region being located within the games playing area at a location spaced from the wall portion wherein said barrier means is having adjustment so as to alter the size of the games playing area and the tension for rebounding the ball into play.

According to another aspect of the present invention there is provided a court or area for playing a game comprising a planar playing surface having a boundary to delimit the area of play defined at least in a major part by a flexible barrier means, said flexible barrier means being used to substantially contain the game within the defined playing area when played, the court being arranged such that the barrier means forms part of the playing court and is used to return the game playing piece into play, said barrier means being adjustably connected to a support means to locate it in place and to maintain tension therein, and wherein there is a goal scoring region located in the court and spaced from the wall portion.

In one embodiment of the present invention, the flexible barrier means is substantially continuous around the boundary of the playing area so as to define the walls of the court. In another embodiment the flexible barrier means includes a top cover extending over the playing court to define a playing surface, which in use may be used for returning the game playing piece into play. The top cover additionally covers the goal scoring region.

Typically, the planar playing surface is rectilinear, preferably a square floor.

Typically the games playing area is in the form of a tent-like structure having support from outside the perimeter of the planar playing surface. Typically, the tent-like structure comprises a roof portion and a wall portion. Typically, the roof portion is separate from the wall portion. Typically, the wall portion defines a cuboid-like playing area. Typically the roof portion has a central part located at the higher elevation than the perimeter portion arranged so that there is a slope from the central part of each of the perimeter portions in a pyramid-like manner.

Typically, the goal area is centrally located above the central area of the planar playing surface, and underneath the central part of the top cover having the higher elevation. Typically there are two sets of goal scoring baskets located back to back to each other. Typically, the two sets of baskets are separated by a backboard, preferably two backboards. Preferably, one set of goal scoring baskets are in use at any one time.

Typically, each basket set comprises a main scoring basket and at least one, preferably two, auxiliary scoring baskets. Typically the main scoring basket is located intermediate the auxiliary scoring baskets, and the main scoring basket is of a smaller size than are the auxiliaries or is harder to score through than the auxiliaries.

DESCRIPTION OF THE DRAWINGS

The present invention will now be described by way of example with particular reference to the accompanying drawings in which.

DETAILED DESCRIPTION OF THE PREFERRED EMBODIMENT

Figure 1:
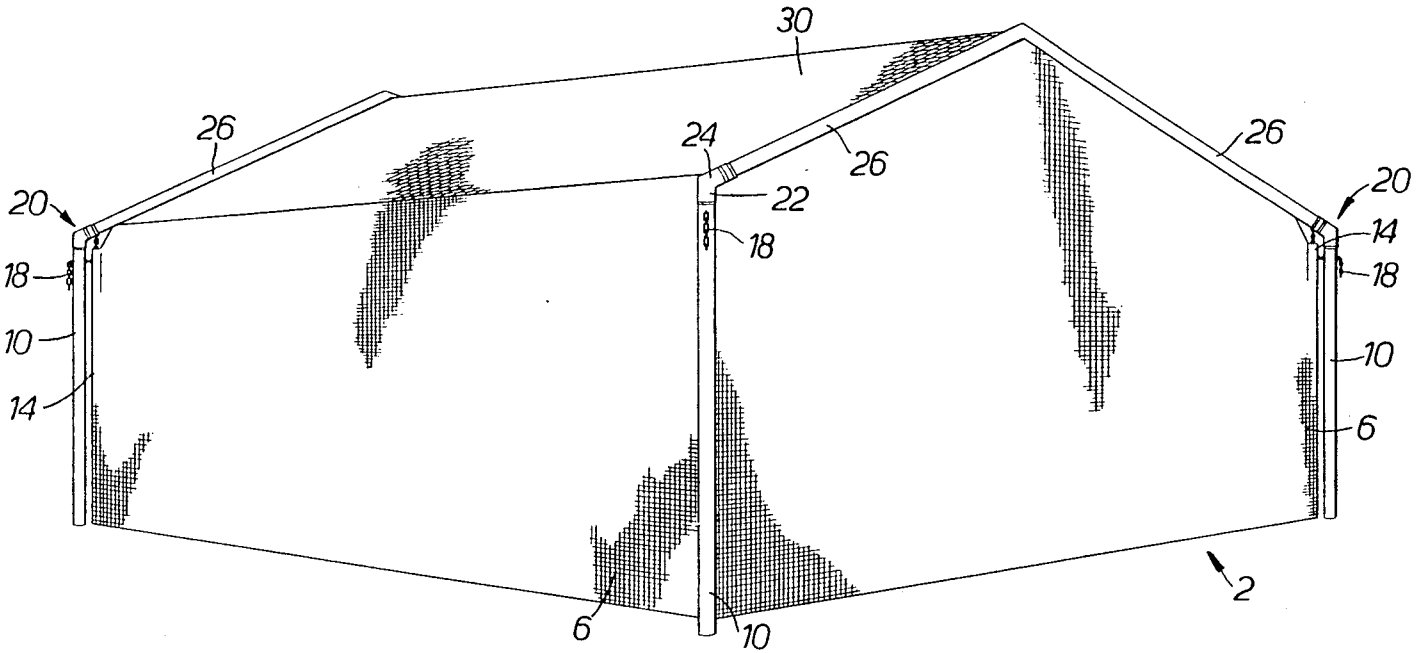
FIG. 1 is a perspective view of one form of a game playing court in accordance with the present invention.
Figure 2:
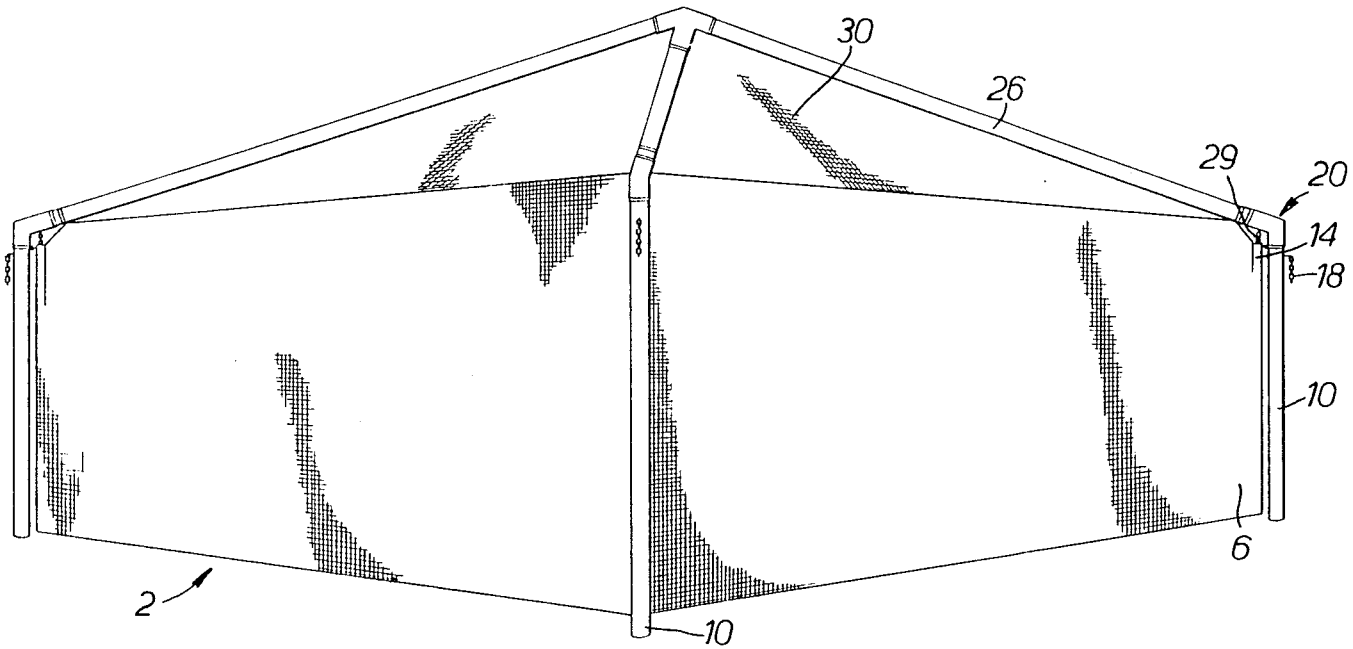
FIG. 2 is a perspective view of another form of the game playing court.

In the drawings there is shown a game playing court or playing area, generally denoted as 2 for playing a game that is an adaptation of the rules of the game of basketball. The court comprises a floor playing surface, a wall playing surface and a ceiling or roof playing surface. One major modification of the rules as applied to the game of the present invention is that the basketball may be rebounded from the side walls and top cover or roof of the court as well as from the floor. Thus, the flexible barrier which surrounds the court forms the side walls and top cover of the court in the described embodiment is part of the playing surface of the game.

More particularly, as shown in the accompanying drawings, the game playing court 2 comprises a game playing floor surface 4, of typically square shape, such as for example 8 m×8 m size, having a centrally located center circle floor portion 5, typically of 3 m diamter. The color of the center circle 5 is preferably of a contrasting color to the remainder of the floor surface 4. Walls 6 of mesh material form the perimeter or boundary of the court and act as a flexible barrier for returning the basketball into play. The mesh material is preferably made from synthetic polymeric material, but any suitable material may be used, including one or more walls 6 being made of a solid material, such as with the walls or normal building construction.

Figure 3:
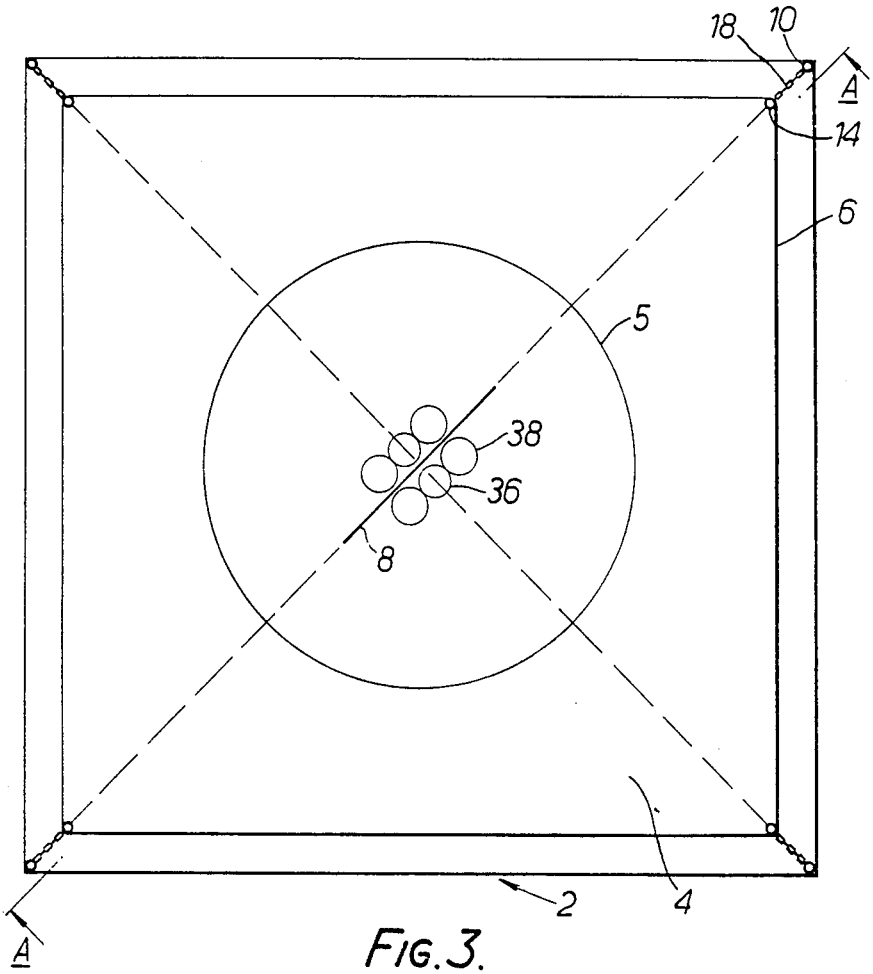
FIG. 3 is a floor plan of the embodiment of FIG. 2.
Figure 4:
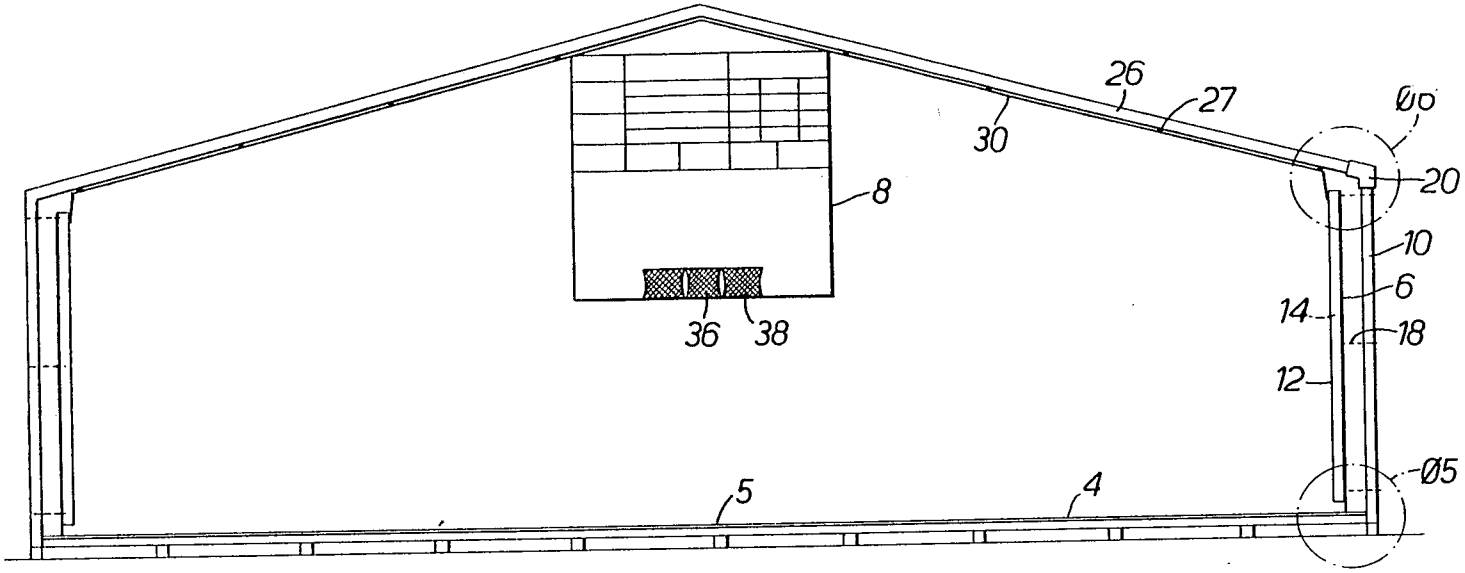
FIG. 4 is a view along line A—A of FIG. 3.

A score board arrangement 8, which is described in more detail later in this specification, is centrally positioned at a suitable height above the center circle 5 and aligned to lie along one or other of the lines joining two opposite corners of the playing court. In one embodiment the score board is supported from two of the rafters 26 spanning or bridging over the court from one corner to the opposite corner. As illustrated in FIG. 3, the score board 8 is aligned along the diagonal joining to two corners along the line A to A.

An upstanding support pole 10 is located adjacent the corners of the playing floor 4, slightly spaced outside the boundary or perimeter of the playing area defined by mesh wall 6. Each support pole 10 is positioned so as to be aligned along the respective lines joining the center of the center circular floor portion 5 to each of the corners of the court as shown in FIG. 3. Thus, the support poles are spaced apart from the mesh wall and the playing area and do not intrude into the court. The support poles are provided in order to support the mesh wall which is releasably secured to the support poles by means of tightening or tensioning chains 18. The support poles also provide support for a top cover 30 also made of suitable mesh material.

Figure 5:
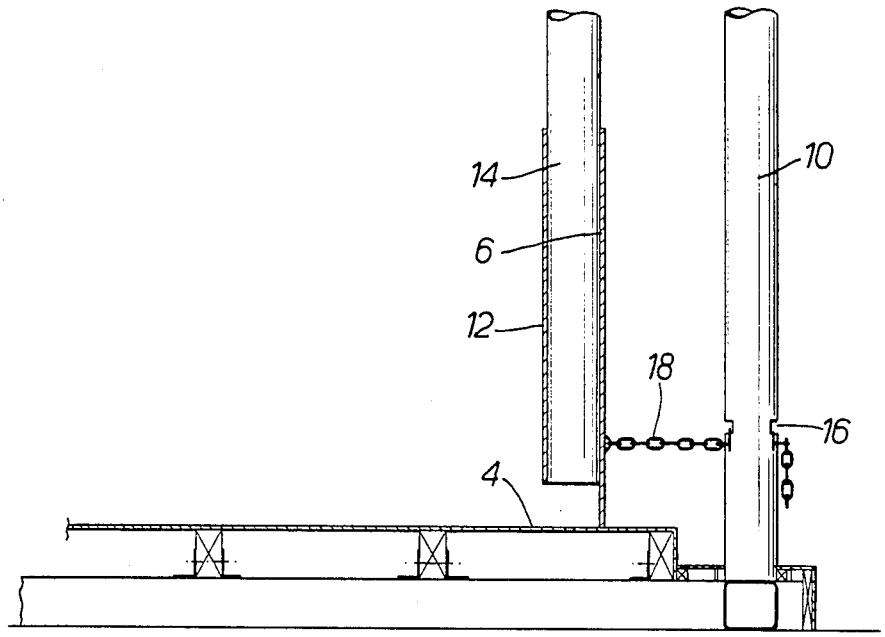
FIG. 5 is an enlarged fragmentary view of the area denoted by circle 5 of FIG. 4.
Figure 6:
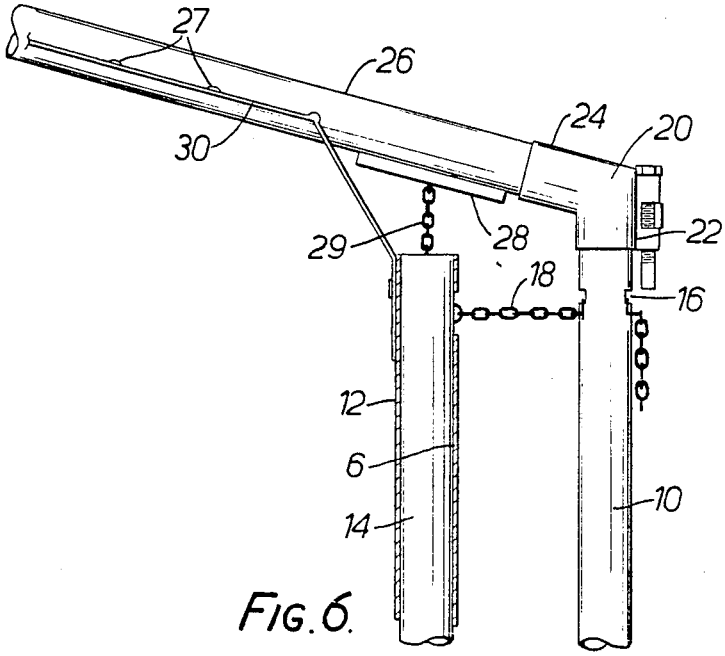
FIG. 6 is an enlarged fragmentary view of the area denoted by circle 6 of FIG. 4.

Longitudinal pockets 12 (FIGS. 5 and 6) extending from ceiling and floor are provided in the mesh wall 6 generally at positions adjacent support poles 10 in use. There are four such longitudinal pockets. A corner post 14 is located within each pocket 12 in use, the corner posts extending from slightly above the floor playing surface 4 to slightly below the lowermost portion of the top cover 30. Each corner post 14 received within pocket 12 is connected to its respective support pole 10 by three chains 18. The three chains 18 are located at the upper end, the lower end, and at an intermediate location of each post. One end of each of the chains 18 is fixedly secured to the corner post and one of the links of the chain at a suitable length is received in a suitably shaped or complimentary shaped slot 16 arrangement. A typical slot arrangement is stepped slot 16 provided on the support post. The stepped slot 16 has a relatively narrow portion and a relatively wide portion so that the links of the chain 18 may pass freely through the wide portion in order to adjust the distance between the corner post and the support pole, which in turn adjusts the tension applied to the mesh wall. The relatively narrow portion is used to retain the chain in place by preventing the links which are wider than the narrow portion from moving through the slot in the direction toward the corner post. Thus, by this means the mesh wall may be adjusted and have different tensions applied to it.

Each side wall 6 of the court is provided with an apron of canvas or like flexible material, including synthetic materials, to fill in the gap between the playing floor 4 and the lower edge of wall 6 and also between the top cover 30 and the wall 6 so as to provide a continuous barrier where the wall meets the floor on the one hand and where the wall meets the top cover on the other hand. The pockets 12 may also be made in the canvas aprons such that the corner post is held from above and below. In this case the pockets need not extend longitudinally.

A tubular elbow 2 having two arms 22, 24 angularly inclined to each other is located at the top of each of the support poles. The top of the support pole 10 is received in arm 22 whereas a roof rafter 26 or similar roof support is received in the other arm 24. The roof rafter 26 spans the top of the playing court from one corner to a location immediately above the center of the center circle 5 where it is joined to the other rafters. Hooks 27 are provided along the lengths of rafters 26 at spaced apart locations so as to provide anchoring points for the mesh top cover 30 of the court. The corner posts 14 received in the pockets 12 of the mesh wall are suspended from the rafter 26 by means of chains 29 which are securely fixed at one end to the top end of post 14 and releasably secured at their other end to a slider 28 connected to rafter 26 so as to be slidably adjustable.

The four rafters 26 meet at a common point above the playing surface as described. One typical arrangement is a regularly spaced four-armed elbow joint. The locations of the attachment points of the chains to the rafters are slidably adjustable by altering the position of the end of chain 29 in slider 28.

The base of the court comprises planar playing surface 4 which, in one embodiment may be tongue and groove treated pine flooring coated with a suitable surface coating, such as for example a long wearing durable polyurethane. The playing surface 4 is raised above the floor of the stadium or similar building by suitable means such as, for example, joists. The apron interconnects the pine flooring and the lower end of post 14.

An access hatch (not shown) or other suitable means allowing the players entry to and exit from the court is provided in one or more of the mesh walls 6. The access hatch is typically provided with releasably securing means so that the mesh wall 6 may be substantially continuous in the region around the access hatch.

The court described is portable and may be assembled or disconnected at will should the space it occupies be required for some other purpose. Since there are no fittings which are located within the court playing area and which are permanent it is possible to convert the court for playing the game of tthe present invention to another use merely by removing the mesh wall and rolling it up and, if required, removing poles 10.

Figure 7:
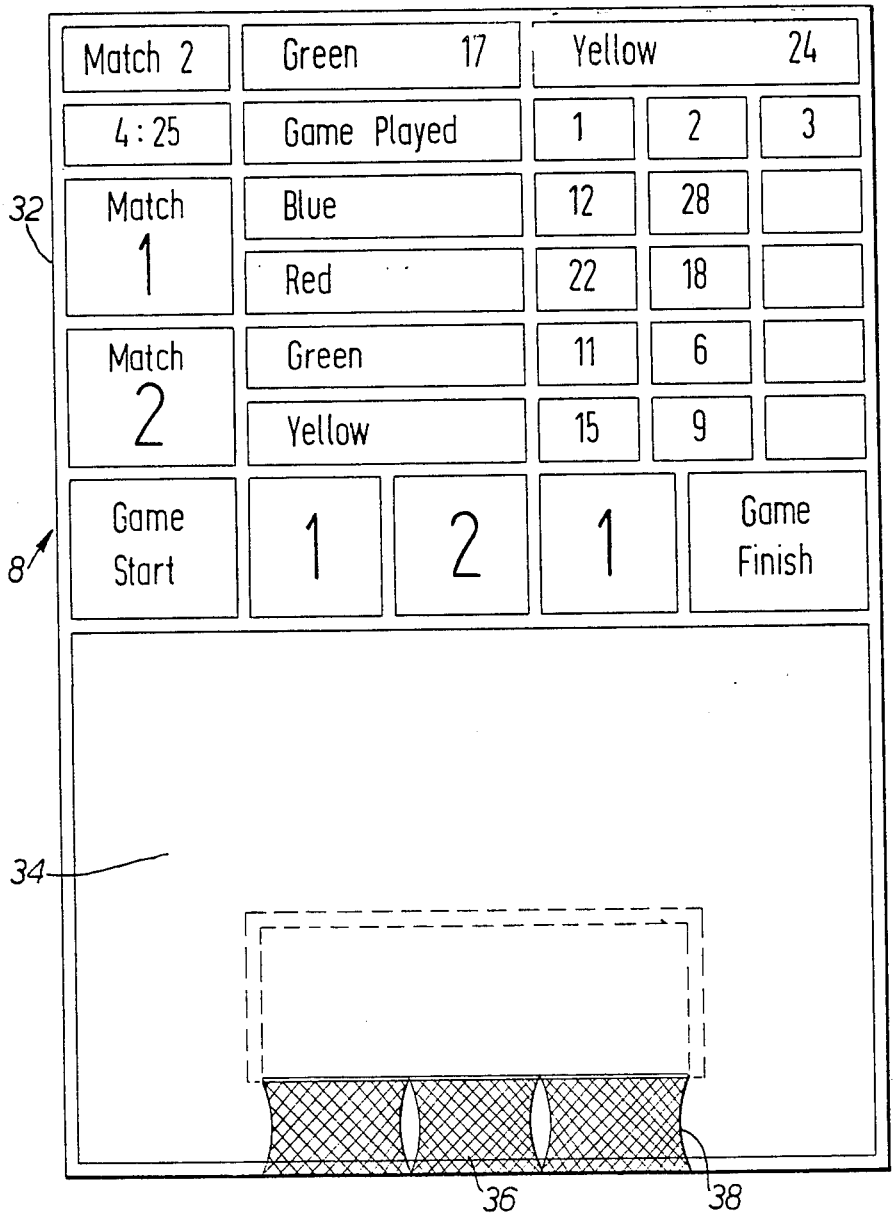
FIG. 7 is a face-on view of one form of the score board, backboard and baskets for use with playing a game in accordance with the present invention.

A typical score board arrangement 8 is shown in FIG. 7, and comprises a backboard 34 and an electronic display portion 32. The backboard is located at a lower level from the display portion. The backboard or lower portion 34 is provided in the described embodiment with three scoring baskets 36, 38, 38, each comprising a sensor means, a hoop or ring and a net depending from the hoop or ring. The baskets are arranged such that basket 36 is centrally located between two outside baskets 38, 38. The diameter of the hoop of basket 36 is smaller than the diameter of the hoops of baskets 38 which are substantially the same size.

A trip lever (not shown) is provided adjacent and slightly below the baskets so that each time a basket ball passes through one of the baskets, the lever is moved to control suitable circuitry to register a successful throw and adjust the score board accordingly. In one form of the game a goal is registered on the score board as two points when the basket ball is thrown through the central basket 36 whereas a single point is obtained and registered on the score board if the basket ball is thrown through either of the outer baskets 38. Typical dimensions of and a typical layout of the score board is shown in FIG. 7. The backboard is typically a clear Plexiglas or other suitable material.

One form of the rules of the game played on the court in accordance with the present invention will now be described.

Each team shall consist of 2, 3, 4 or more players. The teams shall be graded by age, sex and skill for competition play. Top skill can be denoted as 1, then lesser skills ranging from 2 down to 10.

Typical grading includes Teams shown as thus:

(a) Grade A being open in Mens and Womens;

(b) Grade B being over 18 years in Mens and Womens;

(c) Grade C being over 16 years in Mens and Womens;

(d) Top Juniors over 14 years in Mens and Womens;

(e) Juniors 10 years, 11 years, 12 years, 13 years.

(A 1 M)-(B 3 W)-(JUN 11 Boys)

Typical handicaps may be that if one higher Grade Team wishes to play a lesser Grade Team, then for each player of the lesser Grade team allow a handicap of six points per Grade per player, e.g. Grade B Skill 2 Team with three team members called Blue wishes to play a team of Grade C Skill 3 with three team members called Red. Grade B to C=six points per team member. (Three team members=eighteen points). Skill 2 to 3=six points per team member (three team members=eighteen points). Therefore, Handicap=36 points to the Red Team for the match of 12 points per set.

The Court

A typical court may include the following features:

(a) The court floor 4 may have a timber or similar surface;

(b) the court floor 4 dimensions may be 8 m×8 m square;

(c) the inner circle 5 in the center of the floor may be 3 m in diameter and be of a darker or lighter contrasting color than the remainder of the court floor;

(d) the mesh wall 6 around the court may extend from the floor to a height of 3 or 4 m;

(e) the mesh wall 6 shall be tight and pulled taut around the court and have a mechanism to tighten it, such as for example chain 18 and slot 16 previously described;

(f) the net over the top of the court, i.e. top cover 30 shall completely cover the court and be taut;

(g) the serving lines shall be one meter long and be at right angles to the plane of the backboard 34 and be 1 m from the outside edge of the inner circle.

Typical Scoring Baskets

There are three baskets for each side.

The three baskets are in line and their dimensions are:

(a) height from floor 4 of court to top side of baskets frame—3 m;

(b) the inside dimension of the two outside baskets 38 is 500 mm and the inside dimension of the center basket 36 is 450 mm;

(c) the net of the baskets shall enclose each frame and have a drop of not less than 500 mm;

(d) each basket shall have a trip switch connected to the score board 8 for automatic scoring.

The Backboard

The backboard 8 shall be fitted into a steel frame which shall have the following dimensions: length 2.3 m and height 0.5 m.

The backboard 34 shall be formed from clear Plexiglas 25 mm thick.

The Score Boards

The present game score board shall show from each side, the results of all baskets in each set, one, two and three. Plus the cummulative score for each team and an elapsed time clock.

The resting game score board shall have a memory and hold score until required for the next set on the present game score board.

The Game

The two teams of 2, 3, 4 or more players each, play with a regulation basket ball.

Object of the game is to score points by putting the ball into the scoring nets.

The two outside nets give a score of one point, the center net gives a score of two points.

Each match is the best of three sets.

Each set has a playing time of 14 minutes with a one minute rest period. Then a one minute period is provided for entry onto the court and to start the next set of the game.

So each match can have a total elapsed time of 45 minutes with an on court time of 42 minutes.

The game starts by one team member serving from the serving line.

This serve of the ball by throwing must bounce off any wall 6, top cover 30 or off the floor 4 before any other player touches or catches it (otherwise another serve by the same player), (if this happens more than twice, a free non-scoring throw is given to the offending team).

All shots at the baskets must be from outside the inner circle.

The ball is in play all the time and cannot go out of play unless:

(1) a "score" is made (then the opposing team serves next);

(2) a "progression" means more than one step and pivot is made by any player with the ball (then a free non-scoring throw is given to the other team);

(3) any pushing or shoving by any part of the body to any part of any other player's body (then a free non-scoring throw is given to the other team);

(4) no kicking of the ball (a free non-scoring throw to the other side);

(5) holding the ball for more than four seconds without throwing (a free non-scoring throw to the other team);

(6) any player with more than four infringements must leave the court for the remainder of the set;

(7) any team with more than six infringements must have the player with the most infringements leave the court for the remainder of the set.

The game should have an umpire who manages the game from outside the court.

The team with the highest score wins the game.

The described arrangement has been advanced merely by way of explanation and many modifications may be made thereto without departing from the spirit and scope of the invention which includes every novel feature and combination of novel features herein disclosed.

What is claimed is:

1. A court for a ball game comprising a substantially planar floor surface, a wall portion which at least in part comprises a barrier and a goal arranged so that the barrier forms at least part of the boundary of the area of playing the game and when struck allows for rebounding of the ball into play, and a goal structure located generally centrally of said floor surface and above the floor surface to enable unimpeded access beneath the goal structure, and wherein the goal structure includes a fixed rigid back board rebound and first and second goal targets located on opposite sides of the barrier.

2. A court according to claim 1 in which the wall portion which at least in part comprises a flexible barrier forms a substantially continuous boundary around the perimeter of the games playing area.

3. A court according to claim 2 in which the flexible barrier comprises a roof portion covering the games playing area so as to define a substantially closed space in which the game is played, said roof portion being above said goal structure.

4. A court according to claim 3 in which the wall portions are supported externally to the games playing area by support poles.

5. A court according to claim 2 in which the flexible barrier is of a mesh or net-like construction.

6. A court according to claim 5 in which the wall portions are supported externally to the games playing area by support poles.

7. A court according to claim 5 in the form of a tent-like structure, said tent-like structure being supported externally by support members located adjacent each of the corners thereof and suspended from roof rafters overlying the structure.

8. A court according to claim 7 in which the goal structure includes secondary goal targets, said secondary goal targets requiring a lesser degree of skill and accuracy to score than for said first and second goal targets.

9. A court according to claim 7 wherein said floor surface is square and said flexible barrier lies in a plane which includes a diagonal of said square floor surface.

10. A court according to claim 2 in which the wall portions are supported externally to the games playing area by support poles.

11. A court according to claim 1 in which the barrier comprises a roof portion covering the games playing area so as to define a substantially closed space in which the game is played, said roof portion being above said goal structure.

12. A court according to claim 3 in which the wall portions are supported externally to the games playing area by support poles.

13. A game adapted for playing on a court according to claim 1.

14. A court according to claim 1 in which the wall portions are supported externally to the games playing area by support poles.

15. A court for a ball game comprising a substantially planar floor surface, a wall portion which at least in part comprises a flexible barrier and a goal arranged so that the flexible barrier forms at least part of the boundary of the court to limit the area of playing the game and when struck allows for rebounding of the ball into play, and a goal structure located generally centrally of said floor surface and above the floor surface to enable unimpeded access beneath the goal structure, said flexible barrier forming a substantially continuous boundary around the perimeter of the games playing area and being formed of a mesh or net-like construction in the form of a tent-like structure supported externally by support members located adjacent each of the corners thereof and suspended from roof rafters overlying the structure; wherein the goal structure includes a barrier and first and second goal targets located on opposite sides of the barrier and secondary goal targets, said secondary goal targets requiring a lesser degree of skill and accuracy to score than for said first and second goal targets.

16. A court according to claim 15 including adjustment means operable to alter the tension in the flexible barrier, said adjustments comprising a flexible member and slot arrangement, said flexible member extending from a movable support member to a fixed support member, such that the flexible member is fixedly secured to the movable support element and releasably secured to the fixed member, said slot being provided in the fixed support member to retain the flexible member.

17. A court according to claim 16 in which the flexible member is a chain and slot arrangement is a stepped slot having a relatively narrow portion and a relatively wider portion, said chain capable of freely passing through the wider portion and said chain being retained by the narrower portion.

18. A court according to claim 16 in which the fixed support member is connected to the roof portion at an angle by an intermediate rigid member and the movable support member is connected to the roof portion by a flexible member.

* * * * *

UNITED STATES PATENT AND TRADEMARK OFFICE

CERTIFICATE OF CORRECTION

PATENT NO. : 4,715,598

DATED : December 29, 1987

INVENTOR(S) : John K. Knight

It is certified that error appears in the above-identified patent and that said Letters Patent is hereby corrected as shown below:

Column 7, line 16 (last line of Claim 1), delete "barrier" and insert --backboard rebound--.

Signed and Sealed this

Twenty-seventh Day of September, 1988

*Attest:*

DONALD J. QUIGG

*Attesting Officer*

*Commissioner of Patents and Trademarks*